US009546030B2

(12) United States Patent
Lombardi et al.

(10) Patent No.: US 9,546,030 B2
(45) Date of Patent: Jan. 17, 2017

(54) HAT MAKING KIT AND PACKAGING METHOD THEREFORE

(71) Applicant: The Dollfus Mieg Company, Inc., Edison, NJ (US)

(72) Inventors: Dominick Lombardi, Kearny, NJ (US); Luis Carlos Schmitz, Balneario Camboriu (BR)

(73) Assignee: The Dollfus Mieg Company, Inc., Edison, NJ (US)

( * ) Notice: Subject to any disclaimer, the term of this patent is extended or adjusted under 35 U.S.C. 154(b) by 0 days.

(21) Appl. No.: 14/996,072

(22) Filed: Jan. 14, 2016

(65) Prior Publication Data

US 2016/0214777 A1 Jul. 28, 2016

Related U.S. Application Data

(60) Provisional application No. 62/106,873, filed on Jan. 23, 2015.

(51) Int. Cl.

| | |
|---|---|
| ***B65D 71/06*** | (2006.01) |
| ***B65D 63/10*** | (2006.01) |
| ***B65B 61/20*** | (2006.01) |
| ***D04B 1/24*** | (2006.01) |
| ***B65D 67/00*** | (2006.01) |

(52) U.S. Cl.

CPC ..... *B65D 71/063* (2013.01); *B65B 61/20* (2013.01); *B65D 63/10* (2013.01); *B65D 67/00* (2013.01); *D04B 1/24* (2013.01); *B65D 2203/12* (2013.01)

(58) Field of Classification Search

CPC ..... D04B 3/00; D04B 3/06; D04B 33/00; A42B 1/004; A42B 1/041; A42B 1/24; A42B 1/248; B44D 2/002; B65D 75/12;B65D 75/366; B65D 75/5822; B65D 2575/366; B65H 49/08; B65H 49/16; B65H 49/18; B65H 2701/31; D02G 1/14; D02G 3/32; D02G 3/328; D02G 3/408; D05C 1/065

USPC ..... 206/1.7, 223, 225, 227, 388, 392, 409, 206/457, 459.1, 459.5, 512, 574–575, 206/599; 2/171, 175.1, 195.1, 195.8, 2/209.13, 244, 906; 66/1 A, 125 R, 179; 220/507, 524, 554

See application file for complete search history.

(56) References Cited

U.S. PATENT DOCUMENTS

| | | | | |
|---|---|---|---|---|
| 2,264,664 A * | 12/1941 | Geisman | ..... | D04B 3/06 242/137.1 |
| 2,508,173 A | 5/1950 | Kellerman | | |
| 2,778,488 A * | 1/1957 | Brown | ..... | D04B 3/00 206/227 |

(Continued)

FOREIGN PATENT DOCUMENTS

ES 2245242 A1 * 12/2005 ..... D02G 3/34

OTHER PUBLICATIONS

"DIY: Pom Pom Beanie—Swell Blog." Swell Blog. Oct. 4, 2013. Web. Apr. 26, 2016. <http://blog.swell.com/DIY-Pom-Pom-Beanie>.*

(Continued)

*Primary Examiner* — J. Gregory Pickett
*Assistant Examiner* — Brijesh V. Patel
(74) *Attorney, Agent, or Firm* — Gordon Rees Scully Mansukhani LLP; Kathryn Hull; David Heckadon

(57) ABSTRACT

The disclosure herein relates to a kit for creating a knitted garment such as a hat. The kit includes a length of yarn, a topper, a stabilizer, and optionally instructions for creating the garment from the yarn, topper and stabilizer. A method (Continued)

of packaging the kit for an effective presentation to the purchaser is also provided.

19 Claims, 8 Drawing Sheets

(56) References Cited

U.S. PATENT DOCUMENTS

| | | | | | |
|---|---|---|---|---|---|
| 2,921,676 | A * | 1/1960 | Carignan | B65D 75/5822 | 206/409 |
| 3,035,689 | A | 5/1962 | Arnheiter | | |
| 3,425,206 | A * | 2/1969 | Holton | D02G 1/14 | 264/167 |
| 4,032,012 | A * | 6/1977 | Bishop | A41H 31/00 | 2/171 |
| 4,081,154 | A * | 3/1978 | Miszkwitz, Jr. | B65D 75/366 | 242/129.8 |
| 4,548,055 | A * | 10/1985 | Macdonald | D04B 3/06 | 206/388 |
| D287,421 | S * | 12/1986 | Scaggs | D2/869 | |
| D670,478 | S * | 11/2012 | Kennedy | D2/889 | |
| 2004/0137226 | A1* | 7/2004 | Bruner | D02G 3/32 | 428/373 |
| 2010/0101279 | A1* | 4/2010 | Rawls | D04B 3/00 | 66/1 A |
| 2010/0263180 | A1* | 10/2010 | Machado | D04D 5/00 | 28/145 |
| 2012/0131896 | A1* | 5/2012 | Tung | D02G 1/122 | 57/258 |
| 2012/0261302 | A1* | 10/2012 | Karwowicz | A45D 8/14 | 206/575 |
| 2013/0019380 | A1* | 1/2013 | Sitt | A42B 1/24 | 2/209.13 |
| 2013/0227762 | A1* | 9/2013 | Waldner | A42B 1/004 | 2/209.13 |

OTHER PUBLICATIONS

O'Neil, Emily. "Emily Explains: How Do I Create a Removable Pom-pom?" Berroco Design Studio. Aug. 26, 2015. Web. Apr. 26, 2016. <https://blog.berroco.com/2015/08/26/emily-explains-how-do-i-create-a-removable-pom-pom/>.*

Haynes, Christine. "Sewing Basics: How to Sew a Reinforced Button." The Craftsy Blog. Dec. 3, 2014. Web. Apr. 26, 2016. <http://www.craftsy.com/blog/2014/12/how-to-sew-a-reinforced-button/>.*

Knitterly. Attaching a Removable Pom Pom. Jul. 14, 2015. Web. Apr. 26, 2016. <http://www.knitterly.net/blogs/news/18073096-attaching-a-removable-pom-pom>.*

"How to Attach a Pom Pom—LoomaHat.com." LoomaHatcom. Jun. 4, 2013. Accessed Jul. 14, 2016. http://www.loomahat.com/how-to-attach-a-pom-pom/.*

International Searching Authority, International Search Report for International Application No. PCT/US2016/014321, mailed date Mar. 24, 2016, 4 pages.

International Searching Authority, Written Opinion for International Application No. PCT/US2016/014321, mail date Mar. 24, 2016, 6 pages.

* cited by examiner

HAT MAKING KIT AND PACKAGING METHOD THEREFORE

FIELD OF INVENTION

The present disclosure relates to a kit for the construction of a finished product, particularly knitted products. The present disclosure also relates to methods of packaging the kit for an effective presentation to the purchaser.

BACKGROUND

Knitting and crocheting hand-made garments is a custom that is often passed down from generation to generation, providing a skill that can be used for a lifetime. While hand-made clothing is no longer a necessity for many people, many still enjoy the hobby of knitting garments, blankets, or any number of other items in a large variety of patterns and colors.

There continues to be an opportunity to package and combine a novel set of elements to attract a potential customer with a user friendly design that would appeal to the creator of the finished product, a stitcher, as well as the recipient athe finished product.

SUMMARY

This disclosure includes a kit for creating a knitted garment, such as a hat. The kit can include yarn, a topper, a stabiliser, and instructions for creating the garment from the yarn, topper, and stabilizer.

This disclosure also includes a method for packaging a kit of items used to knit a garment, such as a hat. The method can include wrapping yarn into a generally spherical shape. The method further comprises placing a wrapper, the wrapper being printed with a set of instructions, adjacent to the yarn such that an aperture through the wrapper generally corresponds with an axis through the middle of the wrapped yarn. The method may also include mounting a topper upon the wrapped yarn by passing at least a portion of the topper through the aperture of the wrapper and generally though the center of the wrapped yarn. The method may include attaching a stabilizer to the wrapper, encircling the yarn with the wrapper, and connecting together the ends of the wrapper to complete the package.

These and other aspects of the present invention will become apparent to those skilled in the art after a reading of the following description of the preferred embodiments, when considered in conjunction with the drawings, it should be understood that both the foregoing general description and the following detailed description are explanatory only and are not restrictive of the invention as claimed.

The foregoing and still other objects and advantages of the present invention will be more apparent from the following detailed explanation of embodiments of the invention in connection with the accompanying drawings.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
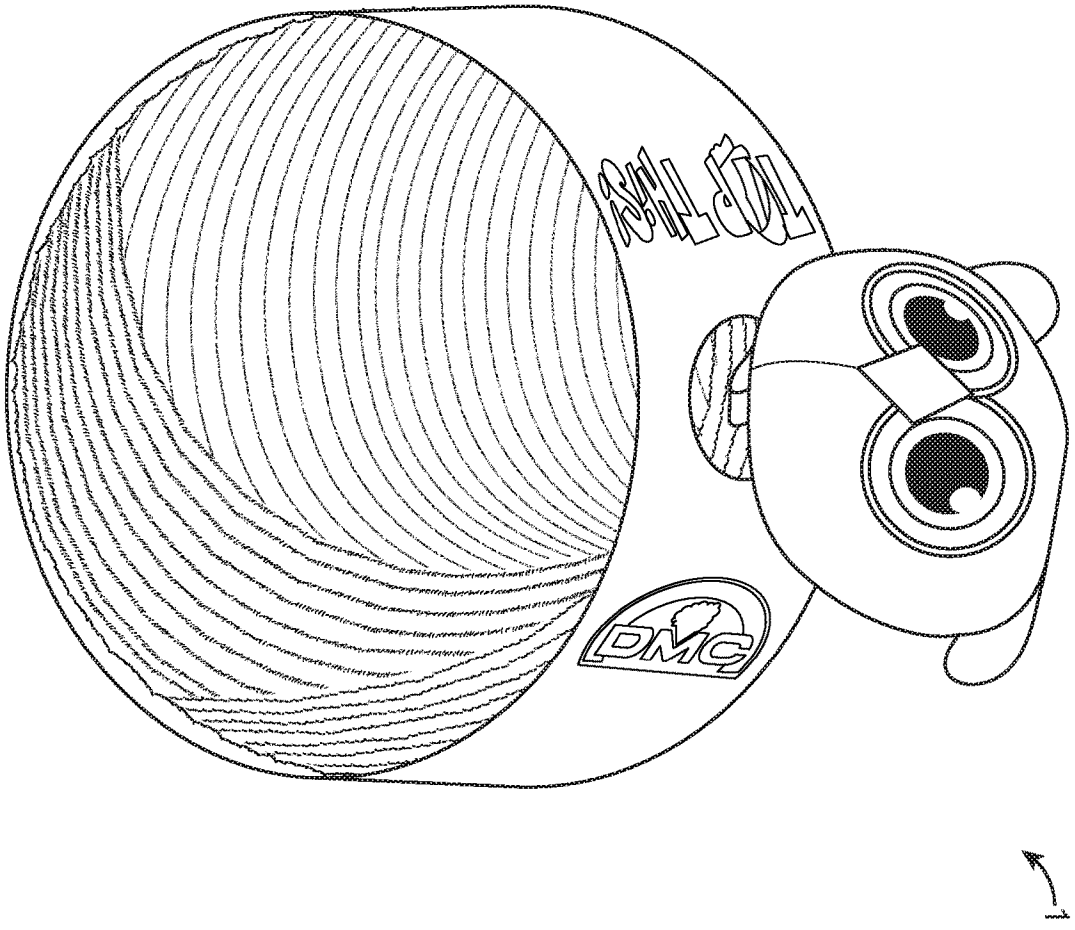
FIG. 1 is a kit according to embodiments of the present disclosure having been packaged by methods of the present disclosure.
Figure 2:
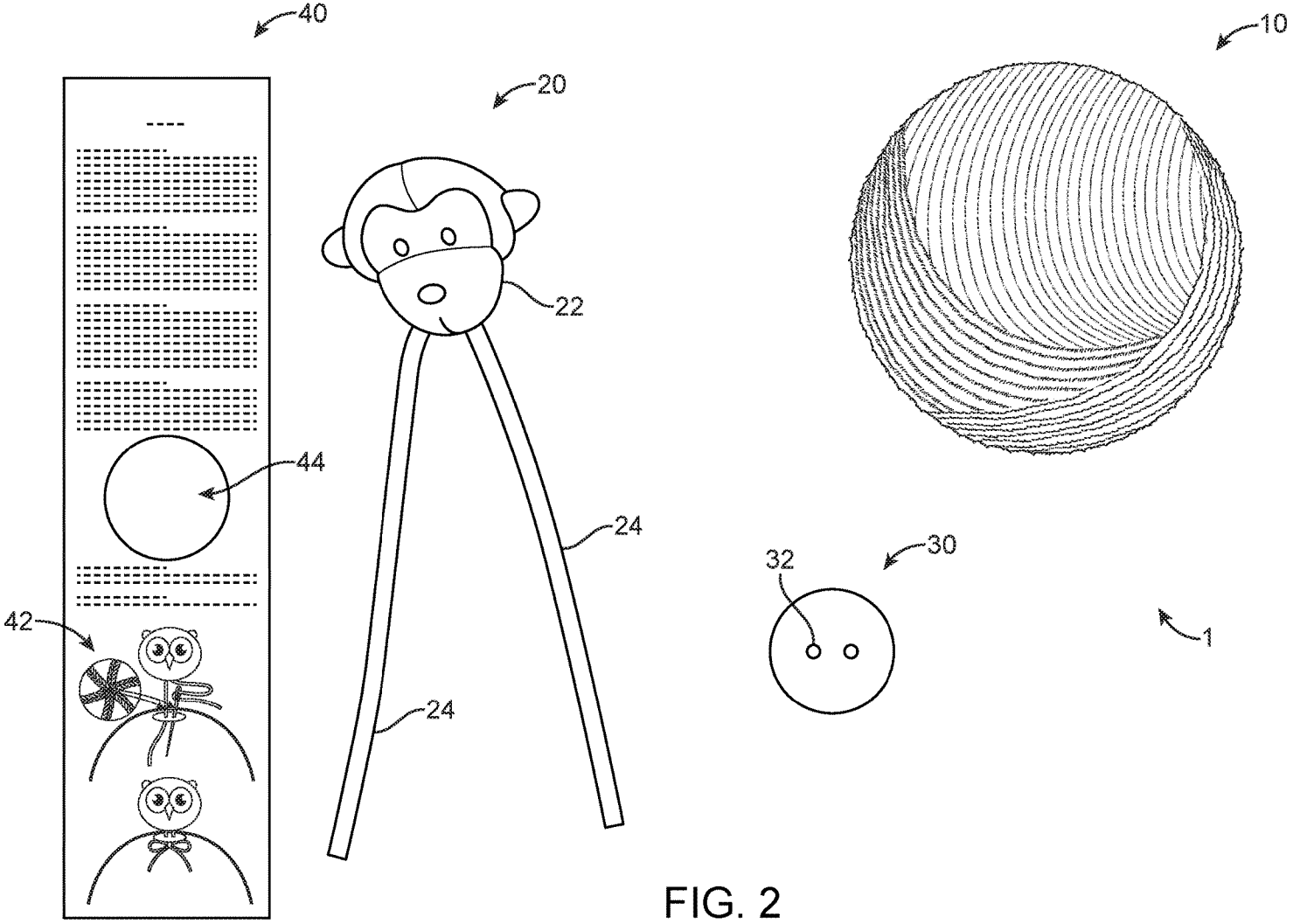
FIG. 2 is an unpackaged kit according to embodiments of the present disclosure.

Turning to the figures, FIG. 1 shoves a kit 1 packaged according to embodiments of the present disclosure. The preferred elements of the kit 1 are more clearly understood from the layout of FIG. 2. FIG. 2 shows the kit 1 having yarn 10 that can be wrapped into a generally spherical shaped ball, a topper 20, a stabilizer 30 and a wrapper 40.

Figure 3:
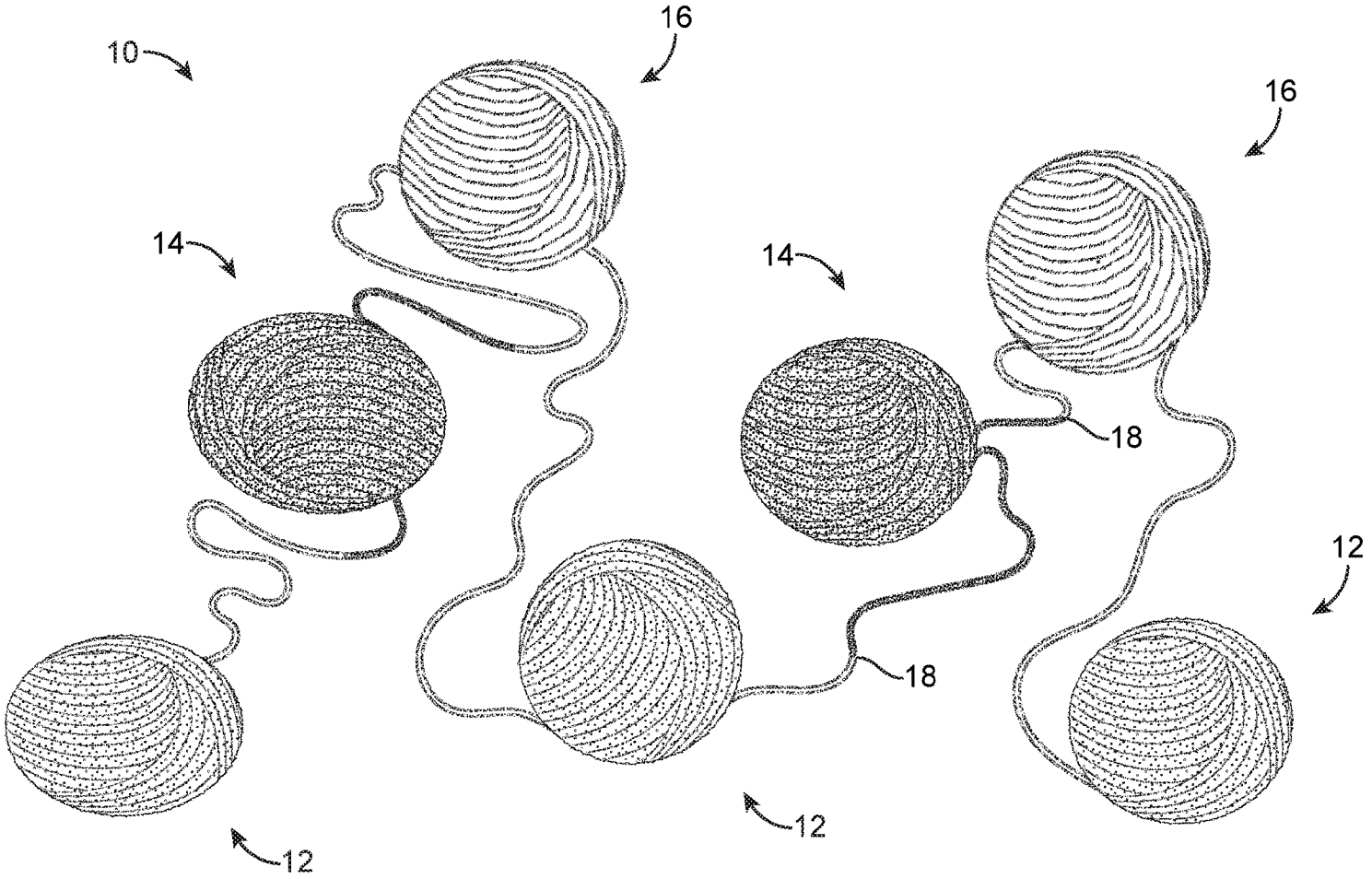
FIG. 3 is a detailed view of the yarn according to embodiments of the present disclosure.

The yarn 10 is shown in a relatively unraveled or unwrapped configuration in FIG. 3. As seen in FIG. 3, the yarn 10 may include a plurality or first segments 12, a plurality of second segments 14, and a plurality of third segments 16. The yarn 10 may be a single continuously attached length with the segments joined together at joining locations 18, so that a stitcher, the person who creates the final garment, does not have to change spools when knitting the final garment 100 (see FIG. 5). The segments are shown as joined together in the following pattern: a first segment 12, a second segment 14, a third segment 16, another first segment 12, another second segment 14, another third segment 16, and a final first segment 12, as seen in FIG. 3. As a result, the yarn 10 starts and ends with a first segment 12. This way the stitcher could start the project from either end of the yarn 10. In other embodiments the total number of segments may vary. In other embodiments, the pattern of segments may vary. While FIG. 3 illustrates three unique segment types, there could be more or fewer segment types. As should be clear from FIG. 3, the length of each segment varies and may be predetermined based upon the knitting pattern being used and the desired completed appearance of the final garment 100.

The yarn 10 should be selected from materials suitable. for use with the final garment 100. If a hat is desired, warm, soft materials or blends may be used. As one example, a blend of 78% acrylic and 22% nylon may be used. The yarn 10 may also vary in length based on the size of the final garment 100. In one example, the yarn 10 is approximately 90 meters in length.

In the illustrated, non-limiting example, the first segments 12 have a first color pattern and texture; the second segments 14 have a second color pattern and second texture. In one example shown, the first and second color patterns are different, but the first and second textures are substantially the same. Further, the third segments 16 have a third color pattern and a third texture. In the illustrated embodiment, the third segments 16 combine the first and second colors. The third texture may be felted to provide the third texture with a feel distinct from the first and second textures.

Turning back to FIG. 2, the topper 20 can include an ornament 22. and the retention 24. In a preferred embodiment the retentioner 24 comprises a pair of attachment straps as shown in FIG. 2. The ornament 22 may take any number of shapes and configurations. Preferably, the ornament 22 is a three-dimensional pre-made plush representation of an animal or other item, such as a sports ball. Generally, the ornament 22 is not capable of being created by knitting techniques using the yarn 10.

The retentioner 24 is connected to the ornament 22 and used for attaching the ornament 22 to the final garment 100. The retentioner 24 may be a variety of materials. The retentioner 24 of the present embodiment is ribbon. The retentioner 24 should be of sufficient length to secure the topper 20 to the final garment 100, and should be of sufficient length to retain the topper 20 as part of the packaged kit 1 shown in FIG. 1. Where straps are used, the retentioner 24 could include two or more straps. In other embodiments, the retentioner 24 could be a button, or equivalent structure, for passing through a smaller or differently shaped opening to provide retention.

Stabilizer 30 may be used to secure the topper 20 to the final garment 100. The use of the stabilizer 30 assists with maintaining the ornament 22 in a generally upright orientation when the final garment 100 is being worn on someone's head. The stabilizer 30 may be provided with one or more through-holes 32 through which the retentioner 24 may be pulled and securely tied in a removable fashion. The number of through-holes may correspond with number of straps of the retentioner 24. The one or more through-holes 32 may be grooves on the edge of the stabilizer 30 to clip a portion of the retentioner 24. The stabilizer 30 may be disk shaped to be round and relatively flat for a comfortable fit. The stabilizer 30 could be other shapes as well, which provide the function of positioning the retentioner 24. Other shapes or structures include annular, e-clip, hexagonal, rectangular, etc. The stabilizer 30 may be formed from foam or other materials that avoid discomfort to the wearer of the final garment 100.

The wrapper 40 can be printed with instructions 42 on an inner surface thereof. Alternatively, the instructions 42 may be printed on an outer surface of the wrapper 40. In even other embodiments, the instructions 42 may be provided separate from the wrapper 40. The outer surface or the wrapper 40 may be printed with labels or other product identification features. The instructions 42 may include the written or visual description of a pattern for knitting the yarn 10 into a body 110 of a final garment 100.

An example of instructions 42 for the body 110 may be:

Using a US X. Y-inch circular needle, cast on A stitches. Place a marker and join, being careful not to twist the stitches. Work K2, P2 rib for B rounds. Work the next C rounds in stockinette stich. On the last round, place a maker every B rounds. A, B and C may be predetermined quantities or varied quantities based on the desired size of the final garment 100 (see FIG. 5).

Switching to double pointed needles as needed, knitting to 2 stitches before the first marker, K2tog. Repeat at each marker until 6 stiches remain to form a 6-point spiral.

To finish the body of the garment, allowing 8 inches, cut yarn and thread onto a yarn needle. Draw the yarn through the remaining live stitches twice and secure, Weave in ends.

Figure 4:
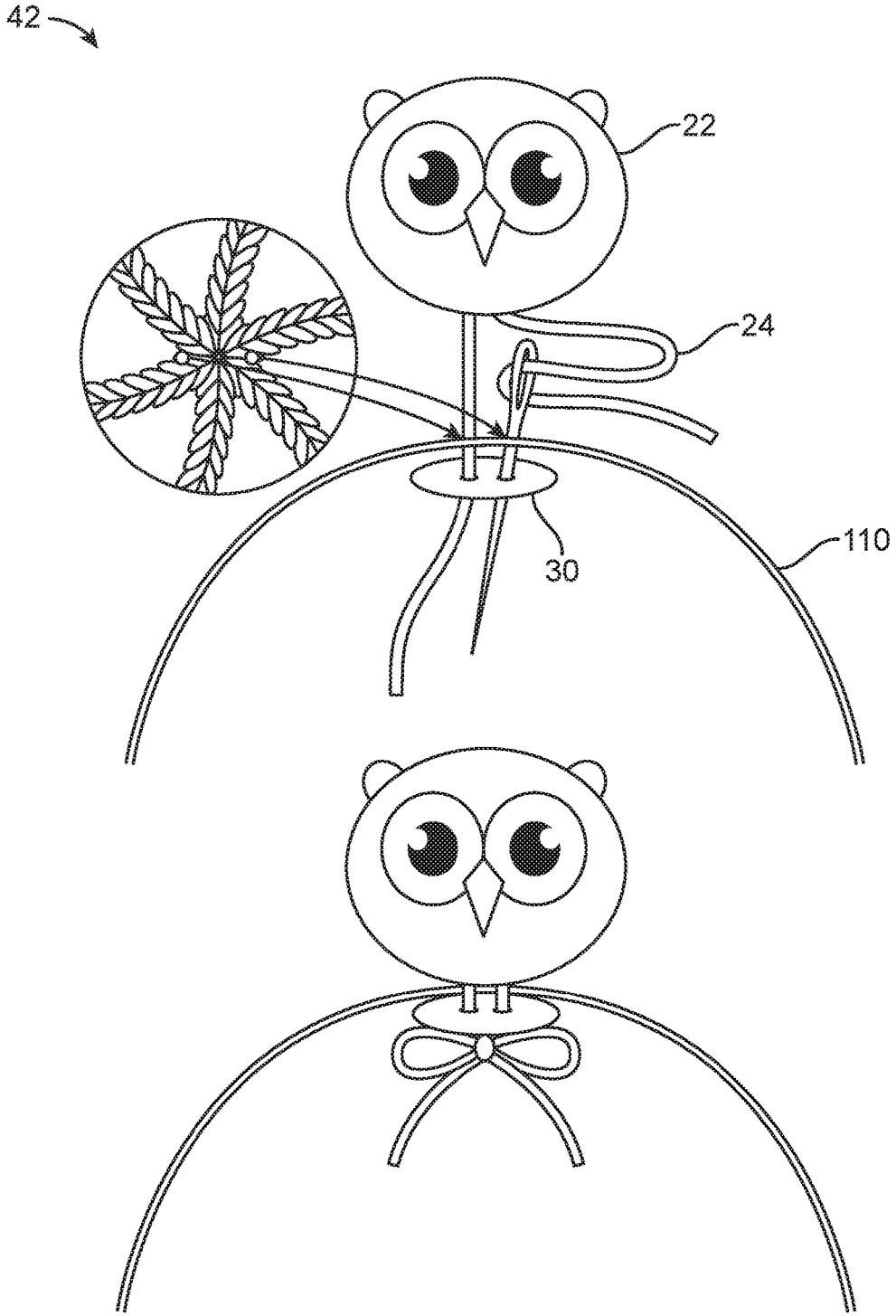
FIG. 4 shows instructions according to an embodiment of the present disclosure.

The instructions 42 may also include a visual or written description for securing the topper 20 to the body 110. A sample set of visual instructions 42 for securing the topper 20 are shown in FIG. 4.

Figure 5:
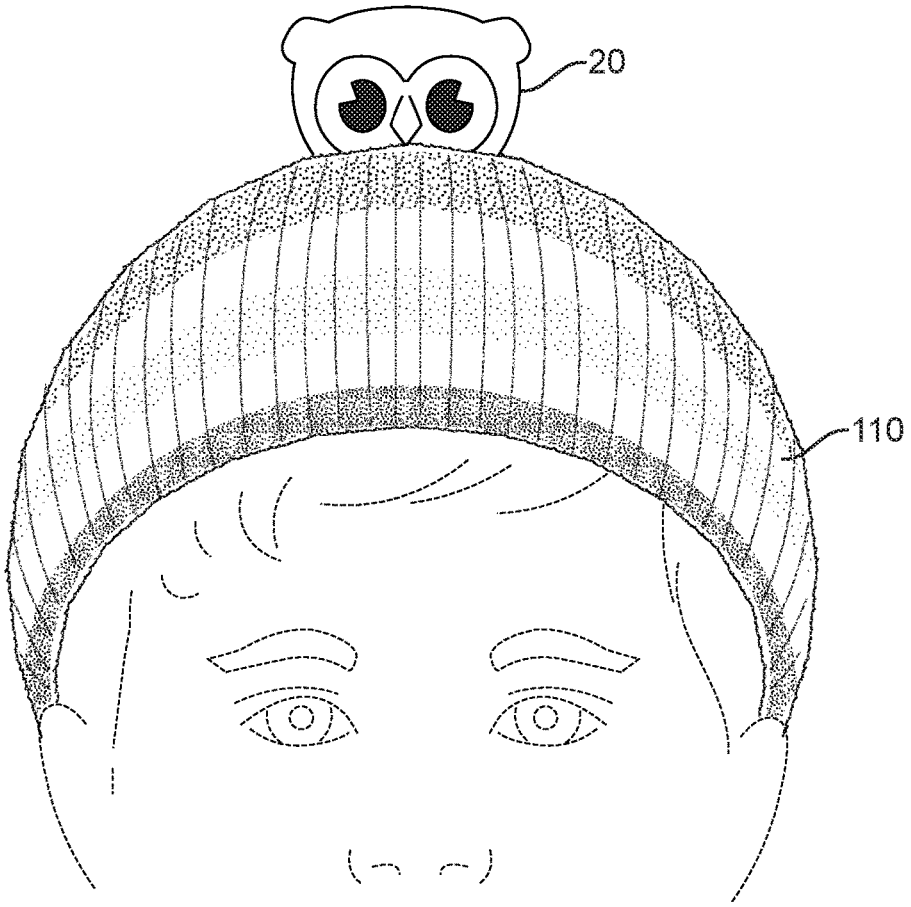
FIG. 5 shows a final garment created using the kit according; to embodiments of the present invention.

An example of a final garment 100 having a body 110 adorned with the topper 20 is shown in FIG. 5.

Figure 6:
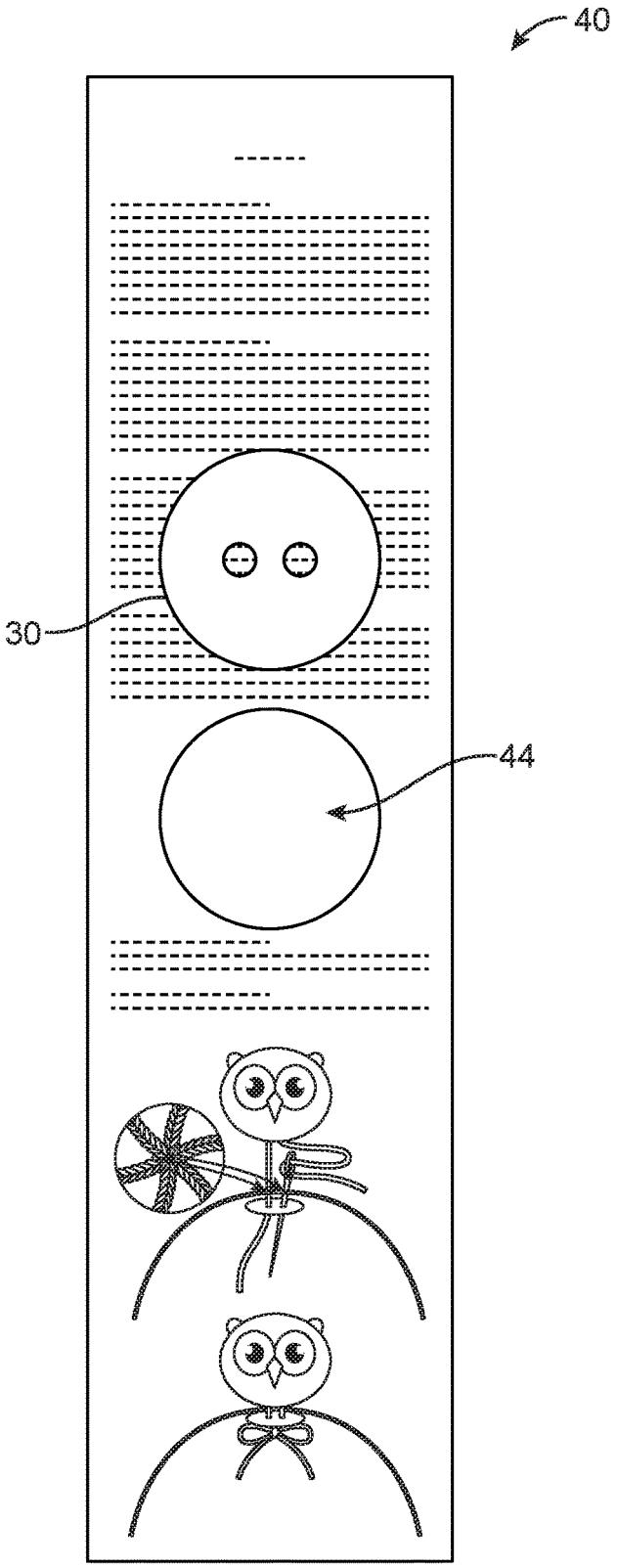
FIG. 6 shows a step of the packaging process according to embodiments of the present disclosure.
Figure 7:
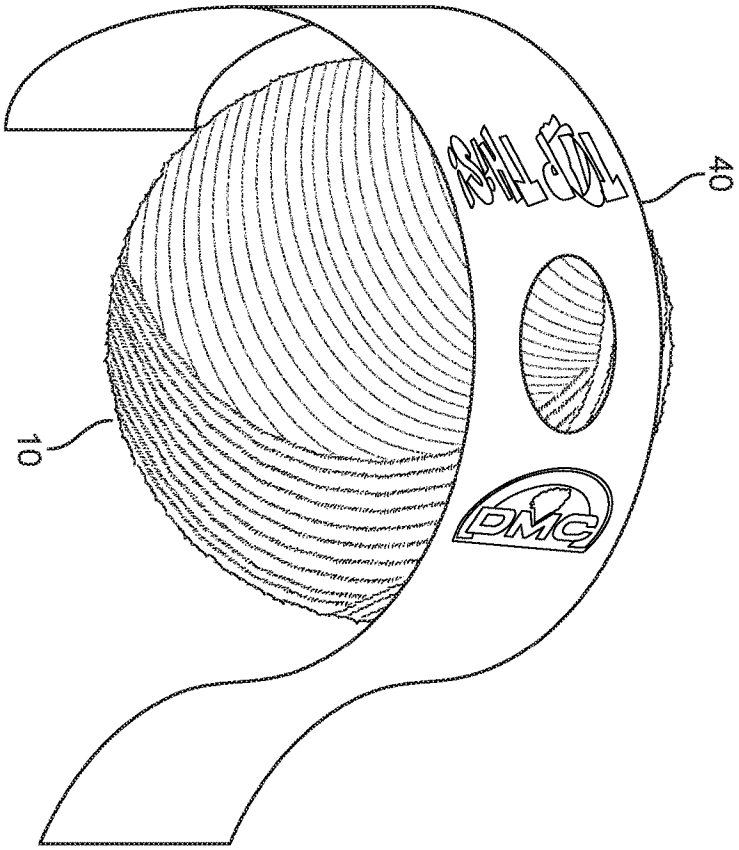
FIG. 7 shows another step of the packaging process according to embodiments of the present disclosure.
Figure 8:
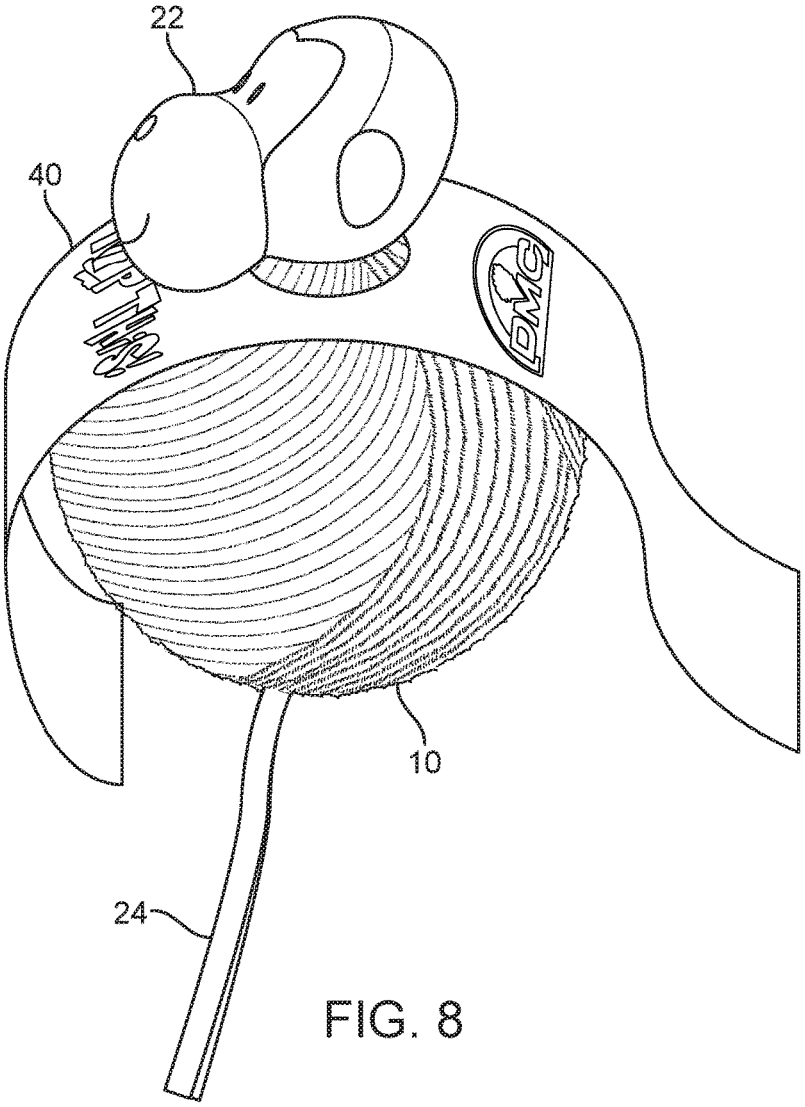
FIG. 8 shows yet another step of the packaging process according to embodiments of the present disclosure.

Moving to FIGS. 6-8, a set of steps is shown for packaging the kit 1 as seen in FIG. 1. The first step in packaging the kit 1 requires providing or obtaining each of the items laid out in FIG. 2. This may include taking a length of yarn 10 and wrapping said yarn 10 into the ball shown in FIG. 2.

FIG. 6 shows the step of securing the stabilizer 30 to the inner surface of the wrapper 40. Adhesive may be used to secure the stabilizer 30 in place. The stabilizer 30 should be securely held in place so that the stabilizer 30 does not inadvertently fall from the packaged kit 1. The stabilizer 30 may be securely packaged in other ways, such as being pre-engaged with the retentioner 24.

FIG. 7 shows the placement of the wrapper 40 with respect to the yarn 10. The aperture 44 through the wrapper 40 should be disposed relative to the wrapped yarn 10 such that an axis through the center of the wrapped yarn 10 would pass through the aperture 44.

FIG. 8 shows the placement of the topper 20 onto the package. The retentioner 24 may be run through the aperture 44 of the wrapper 40 and down approximately through the center of the wrapped yarn 10. As should be clear from the comparison of FIG. 8 with FIG. 1, the package may be completed by encircling the yarn 10 with the wrapper 40, and securing the ends of the wrapper 40 together. The ends may be connected by adhesive. The ends may be connected by other means such as a tab and a corresponding slot. In some embodiments, at least a portion of the retentioner 24 may be entrapped between the connected ends of the wrapper 40 to assist with securing the topper 20 as part of the packaged kit 1.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed is:

1. A kit for creating a knitted garment, the kit comprising:

a length of yarn;

a topper;

a stabilizer; and a wrapper having an aperture;

wherein the length of yarn comprises a continuous length having a first segment having a first color and a first texture and a second segment having a second color and a second texture;

wherein the length of yarn is formed as a single continuous length without attaching separate pieces together wherein the first segment is continuously joined to the second segment;

wherein the first color is different from the second color;

wherein the stabilizer comprises a flexible foam;

wherein the wrapper encircles a portion of the length of yarn; and wherein a portion of the topper passes through the aperture.

2. The kit of claim 1, wherein the first texture is different from the second texture.

3. The kit of claim 1, wherein the length of yarn further comprises a third segment having a third color and a third texture, wherein the third segment is continuously joined with the second segment.

4. The kit of claim 3, wherein the third color is different from the first color and the second color.

5. The kit of claim 3, wherein the third texture is different from the first texture or the second texture.

6. The kit of claim 1, wherein the length of yarn is wrapped in a generally spherical shape; and wherein the topper is stacked on top of the length of yarn.

7. The kit of claim 1, wherein the length of yarn is at least 40 meters.

8. The kit of claim 1, wherein the topper comprises an ornament and a retentioner.

9. The kit of claim 8, wherein the retentioner comprises at least two straps.

10. The kit of claim 9, wherein the at least two straps comprise a ribbon.

11. The kit of claim 1, wherein the stabilizer comprises a disk-like shape with at least one through-hole.

12. The kit of claim 1 further comprising instructions for creating a knitted garment.

13. The kit of claim 1, wherein the kit is for creating a knitted garment and wherein the knitted garment is a hat.

14. A method for packaging a kit of items used to knit a garment, the method comprising:

wrapping a yarn into a generally spherical shape;

placing a wrapper adjacent to the yarn such that an aperture through the wrapper generally corresponds with an axis through the middle of the yarn;

mounting a topper upon the yarn by passing at least a portion of the topper through the aperture of the wrapper and generally through the axis through the middle of the yarn;

attaching a stabilizer to the wrapper;

encircling the yarn with the wrapper; and connecting together the ends of the wrapper to complete the package.

15. The method of claim 14, wherein the wrapper comprises a printed set of instructions.

16. The method of claim 14, further comprising entrapping a portion of the topper between the ends of the wrapper.

17. A method for creating a knitted garment comprising the steps of:

obtaining the kit of claim 1;

using a knitting technique to convert the yarn into the knitted garment; and using the stabilizer to attach the topper to the knitted garment.

18. The method of claim 17, wherein the knitting technique comprises knitting or crocheting.

19. The method of claim 17, wherein the knitted garment comprises a hat.

* * * * *